United States Patent [19]

Wilson

[11] Patent Number: 4,614,223

[45] Date of Patent: Sep. 30, 1986

[54] METHODS OF ADDING REACTIVE METALS TO STEELS BEING CONTINUOUSLY CAST

[76] Inventor: William G. Wilson, 820 Harden Dr., Pittsburgh, Pa. 15229

[21] Appl. No.: 378,880

[22] Filed: May 17, 1982

[51] Int. Cl.[4] ..... B22D 11/10

[52] U.S. Cl. ..... 164/473; 164/475

[58] Field of Search ..... 164/55.1, 56.1, 57.1, 164/415, 437, 473, 475; 75/57, 58

[56] References Cited

U.S. PATENT DOCUMENTS

| | | | |
|---|---|---|---|
| 3,459,346 | 8/1969 | Tinnes | 164/473 |
| 4,367,784 | 1/1983 | Praitoni et al. | 164/473 |

FOREIGN PATENT DOCUMENTS

| | | | |
|---|---|---|---|
| 56-23220 | 3/1981 | Japan | 75/57 |
| 0871667 | 6/1961 | United Kingdom | 75/57 |
| 0341599 | 6/1972 | U.S.S.R. | 164/473 |
| 0624934 | 8/1978 | U.S.S.R. | 75/57 |

OTHER PUBLICATIONS

"Cast Steel Practices" of the 1971 Electric Furnace Conference, pp. 31 through 45.

*Primary Examiner*—Nicholas P. Godici
*Assistant Examiner*—Richard K. Seidel
*Attorney, Agent, or Firm*—Buell, Ziesenheim, Beck & Alstadt

[57] ABSTRACT

A method for adding reactive metals to steel being continuously cast to eliminate the problem of tundish nozzle plugging is provided by the steps of continuously casting molten steel through a tundish nozzle while introducing a reactive metal into the molten steel in a form and at a point either above or below the tundish nozzle such that high melting oxides and/or oxysulfides of the reactive metal are not formed in an amount sufficient to cause plugging in the nozzle before passing through the nozzle. A flux can be introduced with the alloy or subsequent to the alloy addition that can lower the melting point of the reactive products below the temperature of the steel going through the tundish nozzle.

8 Claims, No Drawings

METHODS OF ADDING REACTIVE METALS TO STEELS BEING CONTINUOUSLY CAST

This invention relates to methods of adding reactive metals to steels being continuously cast and particularly to methods for adding reactive metals such as aluminum, titanium, zirconium and rare earths that ordinarily react in steel to produce inclusions that plug the tundish nozzles of continuous casting machines in a manner that such plugging is eliminated.

Farrel and Hilty showed in their paper presented at the 1971 Electric Furnace Conference that the oxides and/or oxysulfides of certain elements frequently added to steel for the purpose of deoxidizing or desulfurizing steel will be deposited in the tundish nozzle as the steel flows from the tundish into the continuous casting mold. These deposits can and frequently do form a plug in the nozzle and completely stop the flow of steel. The elements that Farrel and Hilty investigated that would cause tundish nozzle plugging were: aluminum, titanium, zirconium, rare earths (REs) and, in some instances, silicon. The problem of plugging of nozzles when casting steels containing aluminum has been largely overcome by the use of stopper rods in the tundish to control the flow of steel and large nozzles that are not readily clogged by precipitation of alumina. However, this is an imperfect solution and the reaction products deposited in the bores of the tundish nozzles are frequently required to be removed by mechanical or chemical means during the continuous casting of steel. The solution to the tundish nozzle plugging problem applied to aluminum is, however, less than satisfactory as a solution to the problem of nozzle plugging due to additions of titanium, zirconium, or REs because these other materials have been shown to have a greater tendency to plug nozzles than aluminum.

Since titanium, zirconium and REs all have a higher affinity for oxygen and sulfur than aluminum, the cleanness of continuously cast steel can be enhanced with the proper amounts of these elements. Since steel cleanness can be related to improved steel ductility or ability to stretch under load, it is desirable to produce steels as clean as possible.

I have discovered that the addition of reactive alloys such as titanium, aluminum, zirconium and REs, entrained in an inert gas and inserted either below the tundish nozzle into the snorkel or down the tundish stopper rod results in the addition of these metals in such a manner that they do not have time to react with the oxygen and sulfur in the steel to form the tundish nozzle plugging products of reaction found by Hilty in his research. Further, I have discovered that even if some of these solid reaction products are formed that their melting point can be reduced by fluxes so that the melting point of the resulting mixture or compound is lower than the temperature of the steel going through the nozzle. Hilty has shown that inclusions that are liquid going through the tundish nozzle do not result in nozzle plugging.

Guthrie has shown that when metal particles, such as alloy additiosn, are added into steel that the first thing that happens is that the cold particle extracts enough heat from the molten steel that surrounds it, that that steel immediately solidifies into a complete shell around the cold metal particle. There is a finite time necessary for the shell around the cold particle to remelt and only then does the alloy particle begin to go into solution or melt, and a further finite time is necessary to have the alloy go completely into solution in the steel. Once in solution these alloys react with the impurities in the steel such as oxygen and sulfur and form the solid reaction products that are responsible for tundish nozzle blockage.

I have discovered that the times necessary for most of the alloys added with the methods of this invention such as through the tundish stopper rod to dissolve the steel shell formed when they are first added, to go into solution and react with the impurities in the steel to form tundish nozzle blocking inclusion are long enough to prevent tundish nozzle blocking inclusions from forming. Further, if the alloys can be added through a port in the snorkel entrained in the inert gases used at this location for stirring, neither the reactive metals nor their reaction products with impurities of the steel ever comes in contact with the tundish nozzle.

I have further discovered that if the solution time of the reactive alloy added entrained with the gases coming through the tundish stopper rod is so short and their reaction rate with the impurities in the steel is so swift that nozzle blocking inclusion can form in the bore of the tundish nozzle, that such inclusions can be prevented from attaching to the bore of the tundish nozzle if their melting point is reduced by adding a suitable flux simultaneously with the reactive alloy. As an example, if a low melting point alloy of REs were added according to this invention and the alloy went into solution swiftly and reacted swiftly with the impurities to form solid inclusions capable of nozzle blockage while the steel was still in the nozzle, one of the compounds formed would be rare earth oxide, ($RE_2O_3$), whose melting point exceeds 3000° F. It is possible to lower the melting point of the $RE_2O_3$ so formed by reacting it with a flux such as cryolite, $Na_2AlF_6$. One such compound formed with cryolite and $RE_2O_3$ are reacted together is $Na_2(RE)F_4$ whose melting point is less than 1900° F., far below the temperature of the steel going through the tundish nozzle (2800°-2900° F.). Cryolite is not the only compound capable of fluxing $RE_2O_3$, however, most of the compounds capable of fluxing $RE_2O_3$ are halide salts of one kind or another.

I have discovered that the flux necessary to form a compound with the reaction products from the addition of reactive metals which is fluid at the temperature of the steel going through the tundish nozzle can be introduced into the system by at least two methods. The first means is to coat the alloy particle with the flux. This could be accomplished by dissolving the flux in a fluid such as water and then the alloy to be coated can then be immersed in a concentrated solution of the flux and subsequently dried leaving a coating of the flux on the particle. A simpler procedure would be to make an intimate mixture of fine particles of the alloy and fine flux particles so that formation of low melting point compounds can be formed with the reaction products of the alloy and the flux.

I have further discovered that in instances where continuously cast steel must have the ultimate in cleanness that it may be preferable at times to add the reactive metals such as REs either in the ladle or in the tundish to allow a greater time for the flotation of the reaction products from the steel. However, the steel going through the tundish nozzle will contain RE oxides or oxysulfides that can precipitate in the bore of the nozzle and stop the flow of steel through the nozzle. In such instances, a flux such as cryolite can be entrained in the stream of inert gas being injected down the tundish stopper rod. A portion of this flux, when dissolved in the steel just prior to its entry into the tundish nozzle, will contact the high melting point compounds previously precipitated on the nozzle to reduce their melting point below the temperature of the steel going through the tundish nozzle thus dissolving the deposits from the bore of the nozzle.

In the foregoing specification I have set out certain preferred practices and embodiments of my invention, however, it will be understood that this invention may be otherwise embodied within the scope of the following claims.

I claim:

1. A method for adding reactive metals to steel being continuously cast to eliminate the problem of tundish nozzle plugging comprising the steps of:

(a) continuously casting molten steel through a tundish nozzle;

(b) introducing a finely divided reactive metal into the molten steel in finely divided form and at a point and rate in the tundish nozzle such that said reactive metal is substantially unreacted in said nozzle and high melting oxides and oxysulfides of the reactive metal do not come in contact with the bore of the nozzle to cause plugging in the nozzle before passing through the nozzle; and (c) continuously casting the molten steel in a continuous casting system.

2. A method as claimed in claim 1 wherein the reactive metals are one or more members selected from the group consisting of aluminum, titanium, zirconium and rare earths.

3. A method as claimed in claim 1 or 2 wherein the reactive metal is injected into the molten steel in an inert gas in the tundish nozzle through a hollow nozzle stopper rod.

4. A method as claimed in claim 3 wherein the reactive metal is in particulate form and is coated with a flux capable of lowering the melting point of the reactive metal oxides and/or oxysulfides below the pouring temperature of the steel.

5. A method as claimed in claim 3 wherein the reactive metal in particulate form is mixed with a flux capable of lowering the melting point of oxides and oxysulfides of the reactive metals below the pouring temperature of the steel.

6. A method as claimed in claim 5 wherein the flux is cryolite.

7. A method as claimed in claim 1 or 2 wherein the reactive metals is in particulate form and is coated with a flux capable of lowering the melting point of the reactive metal oxides and/or oxysulfides below the pouring temperature of the steel.

8. A method as claimed in claim 1 or 2 wherein the reactive metal in particulate form is mixed with a flux capable of lowering the melting point of oxides and oxysulfides of the reactive metals below the pouring temperature of the steel.

* * * * *